US008624945B1

(12) United States Patent
Hsu

(10) Patent No.: US 8,624,945 B1
(45) Date of Patent: Jan. 7, 2014

(54) PRINTING DEVICE FOR PRINTING A STEREOGRAPH AND RELATED METHOD

(71) Applicant: HiTi Digital, Inc., New Taipei (TW)

(72) Inventor: Fu-Liang Hsu, Taichung (TW)

(73) Assignee: HiTi Digital, Inc., Xindian Dist., New Taipei (TW)

( * ) Notice: Subject to any disclaimer, the term of this patent is extended or adjusted under 35 U.S.C. 154(b) by 0 days.

(21) Appl. No.: 13/798,056

(22) Filed: Mar. 12, 2013

(30) Foreign Application Priority Data

Sep. 28, 2012 (TW) ..... 101135989 A

(51) Int. Cl.
*B41J 2/325* (2006.01)

(52) U.S. Cl.
USPC ..... 347/174; 347/176

(58) Field of Classification Search
USPC ..... 347/171, 172, 174, 176; 400/120.01, 400/120.02, 120.04
See application file for complete search history.

(56) References Cited

U.S. PATENT DOCUMENTS 5,528,420 A * 6/1996 Momochi ..... 359/463
5,557,413 A * 9/1996 Ebihara et al. ..... 358/296
5,764,266 A * 6/1998 Azuma et al. ..... 347/171
6,133,928 A * 10/2000 Kayashima et al. ..... 347/171
2011/0064895 A1* 3/2011 Ohtani et al. ..... 428/32.39
2011/0074906 A1* 3/2011 Imai ..... 347/218
2011/0075175 A1* 3/2011 Imai ..... 358/1.12
2011/0157293 A1* 6/2011 Ohtani et al. ..... 347/215

FOREIGN PATENT DOCUMENTS

JP 2003-011406 * 1/2003 ..... B41J 2/325

* cited by examiner

*Primary Examiner* — Huan Tran
(74) *Attorney, Agent, or Firm* — Winston Hsu; Scott Margo

(57) ABSTRACT

A printing device for printing a stereograph is disclosed in the present invention. The printing device includes an actuating unit, a ribbon, a thermal print head and a controller. The actuating unit conveys a print medium. The ribbon includes a plurality of dye regions and at least a protecting layer. The thermal print head can transfer the dye regions and the protecting layer onto the print medium, and further manufacture a lenticular lens structure on a surface of the protecting layer in a heat working manner. The controller is coupled to the actuating unit and the thermal print head. The controller drives the actuating unit to convey the print medium according to a target image datum, further controls the thermal print head to respectively transfer the dye regions and the protecting layer onto the print medium, and simultaneously manufactures the lenticular lens structure on the protecting layer.

20 Claims, 5 Drawing Sheets

PRINTING DEVICE FOR PRINTING A STEREOGRAPH AND RELATED METHOD

BACKGROUND OF THE INVENTION

1. Field of the Invention

The present invention relates to a printing device and a related printing method, and more particularly, to a printing device and a related printing method capable of simultaneously print images and manufacturing lenticular lens structure on a protecting layer of a ribbon, so as to rapidly form the stereograph.

2. Description of the Prior Art

A stereograph can transfer a viewer's view angle from two-dimensional space into three-dimensional space, so as to restore a scene with depth of field on the stereograph and to improve a sense of reality of the scene. Thus, the viewer can distinguish a distance and a depth of the scene on the stereograph. Method for producing three-dimensional vision utilizes parallax theory, such as adjusting radian of eyes for changing focal lengths of the eyes and adjusting view angles of the eyes. Because the stereograph shows images having different angles and distances on two eyes of the viewer, respectively, parallax is generated between the images viewed by the two eyes, and the images can be analyzed to generate the three-dimensional vision in the viewer's brain. Stereoscopic imaging technique includes holographic images, grating images, lens images, and so on. A method of applying an optical grating structure to image the stereograph is easier than other methods, and is utilized widespread.

Generally, there are two types of common methods for generating the stereograph. One conventional method is printing the images processed by stereographic image processing technique on a back of the optical grating structure directly. The other conventional method is printing the images processed by the stereographic image processing technique on a common print medium, and then gluing the optical grating structure on the common print medium. However, process of gluing the optical grating structure on the print medium is complicated, spends working hours, and needs numerous glue to fix the optical grating structure on the print medium. The conventional methods print the stereograph slowly and increase manufacturing cost. Thus, design of a stereograph printing mechanism capable of printing the stereograph rapidly and having low cost is an important issue in the printing industry.

SUMMARY OF THE INVENTION

The present invention provides a printing device and a related printing method capable of simultaneously print images and manufacturing lenticular lens structure on a protecting layer of a ribbon, so as to rapidly form the stereograph for solving above drawbacks.

According to the claimed invention, a printing device for printing a stereograph is disclosed. The printing device includes an actuating unit, a ribbon, a thermal print head and a controller. The actuating unit conveys a print medium. The ribbon includes a plurality of dye regions and at least one protecting layer. The thermal print head respectively transfers the dye regions and the protecting layer onto the print medium, and further manufactures a lenticular lens structure on a surface of the protecting layer in a heat working manner. The controller is coupled to the actuating unit and the thermal print head. The controller drives the actuating unit to convey the print medium according to a target image datum, controls the thermal print head to respectively transfer the dye regions and the protecting layer onto the print medium, and further controls the thermal print head to manufacture the lenticular lens structure on the protecting layer when the ribbon is transferred onto the print medium.

According to the claimed invention, the controller sets correlation between the print medium and the lenticular lens structure of the protecting layer according to the target image datum.

According to the claimed invention, the controller sets correlation between the print medium and the dye regions according to the target image datum.

According to the claimed invention, the dye regions includes a yellow dye region, a magenta dye region, a cyan dye region and a black dye region.

According to the claimed invention, the ribbon includes a plurality of protecting layers, the thermal print head transfers the protecting layers onto the print medium in a sequential stacking manner.

According to the claimed invention, the thermal print head manufactures the lenticular lens structure on the surface of the protecting layer when the thermal print head transfers the protecting layer onto the print medium.

According to the claimed invention, the thermal print head manufactures the lenticular lens structure on the surface of the protecting layer after the thermal print head transfers the ribbon onto the print medium.

According to the claimed invention, the thermal print head includes a plurality of thermal units. The thermal units heat the surface of the protecting layer in a separated heating manner, so that a structural direction of the lenticular lens structure is substantially perpendicular to a moving direction of the print medium.

According to the claimed invention, the thermal print head includes a plurality of thermal units. The thermal units respectively heat the surface of the protecting layer according to a predetermined parameter in a continued heating manner, so that a structural direction of the lenticular lens structure is substantially parallel to a moving direction of the print medium.

According to the claimed invention, a method for printing a stereograph is disclosed. The method includes receiving a target image datum, moving a print medium, transferring a plurality of dye regions and at least one protecting layer of a ribbon onto the print medium according to the target image datum when the print medium moves, and manufacturing a lenticular lens structure on a surface of the protecting layer in a heat working manner when the ribbon is transferred onto the print medium.

According to the claimed invention, the printing device is a dye sublimation printer. The plurality of dye regions and the protecting layer of the ribbon are transferred onto the print medium in a thermal sublimated manner.

The present invention can utilize the current dye sublimation printer to print the stereograph, an adhesive mechanism is unnecessary to adhere the lenticular lens structure on the print medium. The printing device of the present invention can manufacture the lenticular lens structure on the protecting layer of the conventional ribbon in the heat working manner according to the interlaced image datum when printing the stereograph, and transfer the protecting layer with the lenticular lens structure onto the print medium printed by the dye regions, so as to rapidly complete the stereograph. Therefore, the present invention has advantages of short printing period, low print cost and preferred operating convenience.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
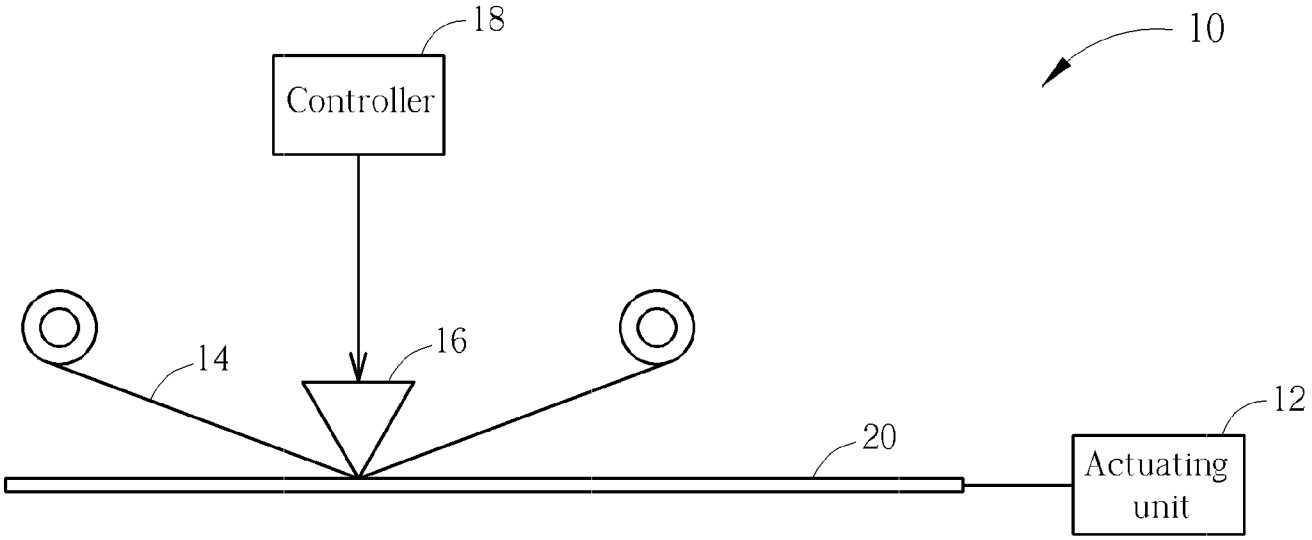
FIG. 1 is a diagram of a printing device according to an embodiment of the present invention.

Please refer to FIG. 1. FIG. 1 is a diagram of a printing device 10 according to an embodiment of the present invention. The printing device 10 can preferably be a dye sublimation printer for printing a stereograph. The printing device 10 includes an actuating unit 12, a ribbon 14, a thermal print head 16 and a controller 18. The actuating unit 12 can include the driving mechanism, such as the motor and the roller, for conveying a print medium 20, such as paper. The ribbon 14 includes a plurality of dye regions 22 and one or more protecting layers 24. The protecting layer 24 is made of high transparency material, and the protecting layer 20 further can be made of protecting material having waterproof function, oilproof function, or anti-UV function, so as to prevent the dye regions from being oozed, faded, or polluted by moisture or oil sludge. In addition, the protecting layer 24 has thermoplastic property. The protecting layer 24 can be deformed by temperature variation to form the structural shape.

For printing the stereograph, the thermal print head 16 of the printing device 10 can transfer the dye regions 22 and the protecting layer 24 onto the print medium 20 in a thermal sublimated manner. The controller 18 is coupled to the actuating unit 12 and the thermal print head 16. The controller 18 can drive the actuating unit 12 to convey the print medium 20 according to a received target image datum, control the thermal print head 16 to transfer the dye regions 22 and the protecting layer 24 of the ribbon 14 onto the print medium 20 in sequence, and control the thermal print head 16 to manufacture a lenticular lens structure 241 on a surface of the protecting layer in a heat working manner. The print medium 20 can perform 3D impression via the lenticular lens structure 241. The target image datum can be an interlaced image datum. For example, the interlaced image datum can be a set of images that is generated by photographing a scene at different view angles and is recorded on the print medium 20 with stripes.

Figure 2:
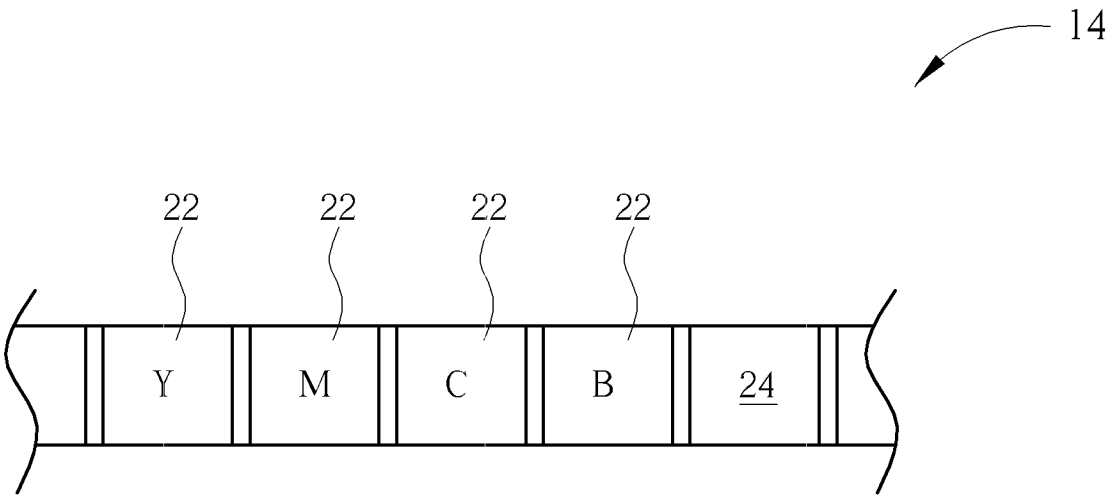
FIG. 2 is a diagram of a ribbon according to the embodiment of the present invention.

Please refer to FIG. 2. FIG. 2 is a diagram of the ribbon 14 according to the embodiment of the present invention. The ribbon 14 includes the plurality of dye regions 22 and the protecting layer 24. The dye regions 22 can include a yellow dye region Y, a magenta dye region M and a cyan dye region C, or include the yellow dye region Y, the magenta dye region M, the cyan dye region C and a black dye region B. The dye regions 22 and the protecting layer 24 are repeatedly arranged on the ribbon 14. Because the lenticular lens structure 241 can be formed on the protecting layer 24 by process of the thermal print head 16, the protecting layer 24 can be a one-layer protection film capable of being deformed by heat, a one-layer cover film capable of manufacturing the lenticular lens structure in the heat working manner, or a two-layer structure which includes the protection film unable to be deformed by heat and the cover film capable of manufacturing the lenticular lens structure in the heat working manner. Compositive structure of the protecting layer 24 is not limited to the above-mentioned embodiment, and depends on actual demand.

Figure 3:
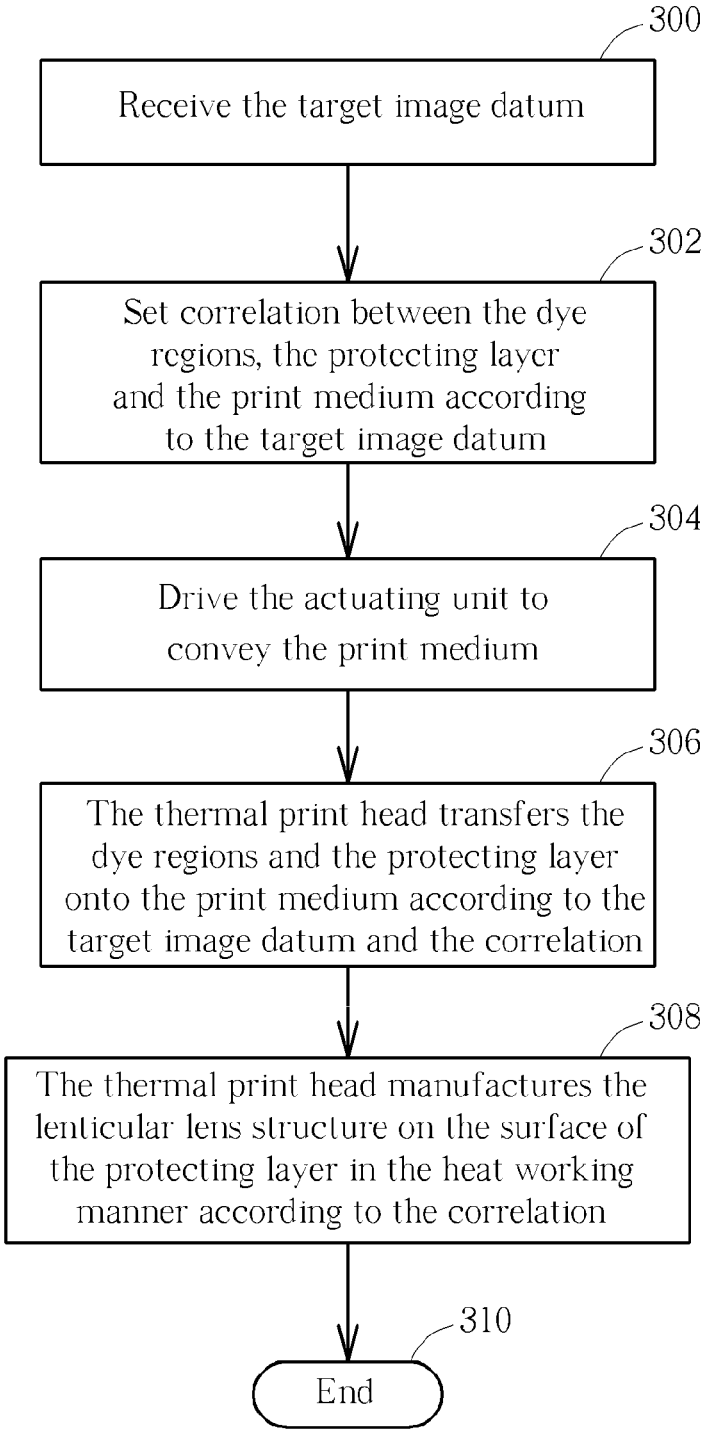
FIG. 3 is a flow chart of printing the stereograph according to the embodiment of the present invention.

Please refer to FIG. 3. FIG. 3 is a flow chart of printing the stereograph according to the embodiment of the present invention. The printing method includes following steps:

Step 300: The printing device 10 receives the target image datum. The target image datum can be the interlaced image datum.

Step 302: The controller 18 sets correlation between the dye regions 22, the protecting layer 24 and the print medium 20 according to the target image datum.

Step 304: The controller 18 drives the actuating unit 12 to convey the print medium 20.

Step 306: The thermal print head 16 transfers the dye regions 22 and the protecting layer 24 onto the print medium 20 according to the target image datum and the correlation.

Step 308: The thermal print head 16 manufactures the lenticular lens structure 241 on the surface of the protecting layer 24 in the heat working manner according to the said correlation.

Step 310: End.

A detailed description of the printing method is introduced as following. First, the printing device 10 receives the interlaced image datum. The controller 18 sets the correlation between the print medium 20, the dye regions 22 and the protecting layer 24 according to the target image datum. After the set of the correlation, the controller 18 moves the print medium 20 passing through a valve (the thermal unit 161 of the thermal print head 16, not shown in FIG. 1 to FIG. 3) of the thermal print head 16 at a predetermined speed. The thermal print head 16 can transfer the dye regions 22 of the ribbon 14 onto the print medium 20 as fringes, and then transfer the protecting layer 24 onto the print medium 20. The thermal print head 16 further can manufacture the lenticular lens structure 241 on the surface of the protecting layer 24 in the heat working manner, so as to complete print of the stereograph.

It should be mentioned that the ribbon 14 can include a plurality of protecting layers 24, which is arranged by the dye regions 22. Before printing the stereograph, the thermal print head 16 can transfer the protecting layers 24 onto the print medium 20 in a sequential stacking manner, which means the protecting layers 24 are transferred onto the same place of the print medium 20, so as to fat the protecting layer 24 on the print medium 20 and to provide a preferred base for the lenticular lens structure 241. In process of printing the stereograph, manufacturing time of the lenticular lens structure 241 can be designed according to parameters of the printing device 10, material property of the protecting layer 24 or heat resistant of the dye regions 22. For example, the thermal print head 16 can control variation of heat working temperature when the protecting layer 24 is transferred onto the print medium 20, so as to simultaneously manufacture the lenticular lens structure 241 on the protecting layer 24. Further, the thermal print head 16 can drive the actuating unit 12 to convey the print medium 20 passing through the thermal print head 16 after the ribbon 14 is completely transferred onto the print medium 20, so that the thermal print head 16 can heat the protecting layer 24 to form the lenticular lens structure 241. The manufacturing time of the lenticular lens structure 241 is not limited to the above-mentioned embodiment, and depends on design demand.

Figure 4:
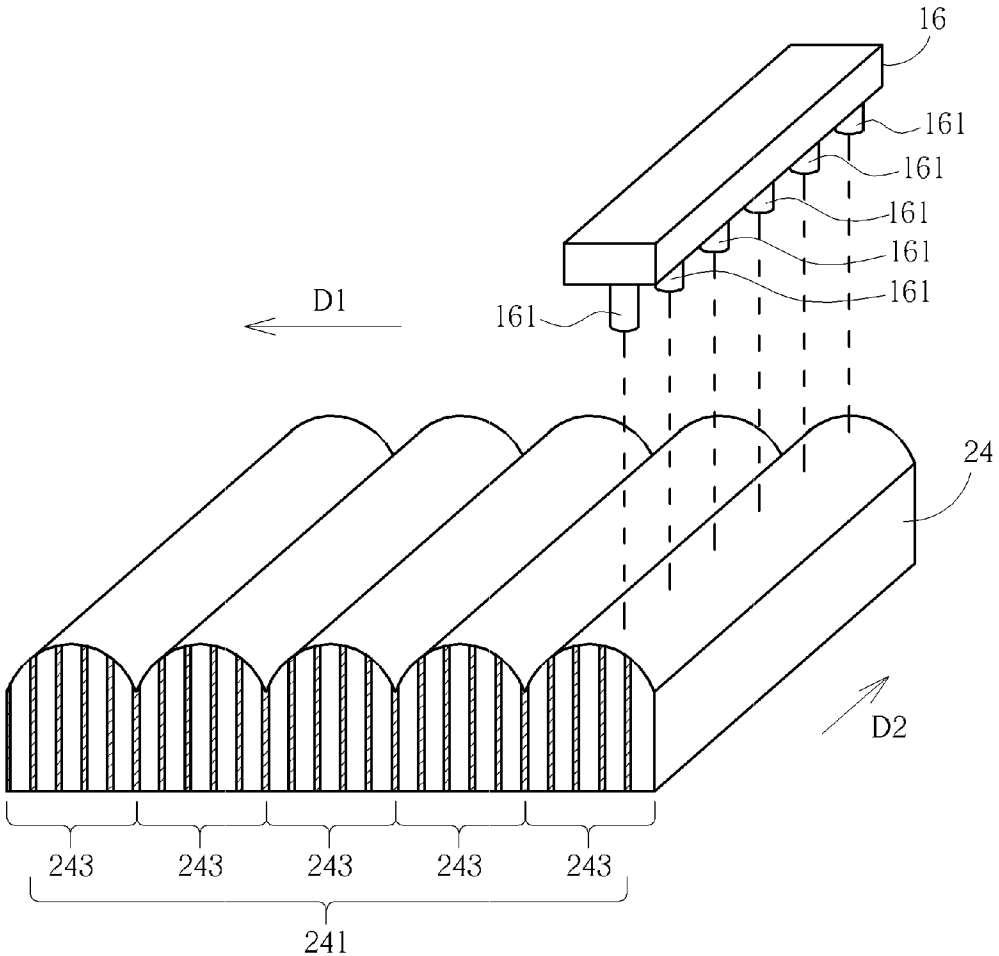
FIG. 4 and FIG. 5 respectively are diagrams of a protecting layer and a lenticular lens structure according to different embodiments of the present invention.
Figure 5:
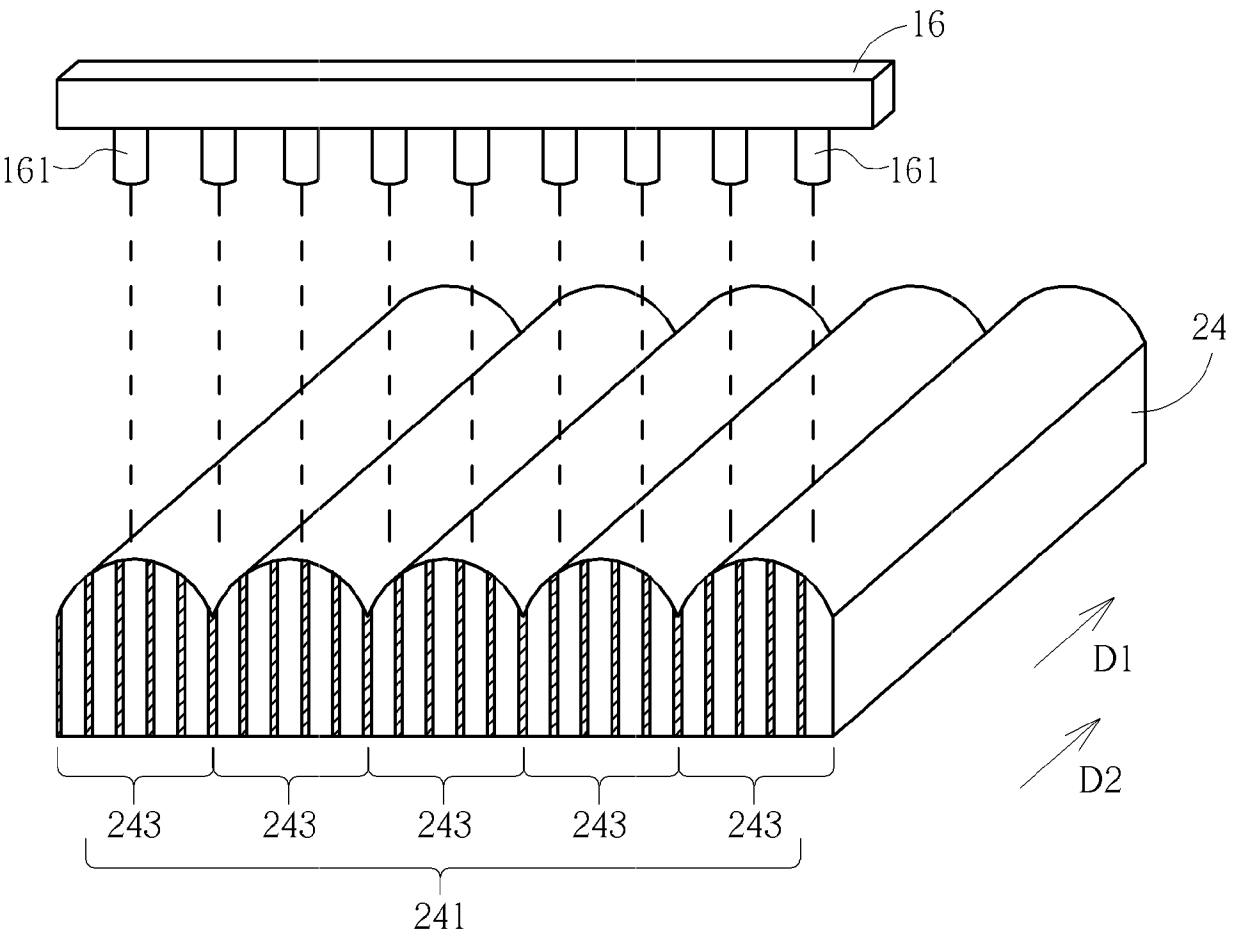

Besides, the thermal print head 16 of the present invention can manufacture the lenticular lens structures 241 with different directions on the protecting layer 24 according to the target image datum. Please refer to FIG. 4 and FIG. 5. FIG. 4 and FIG. 5 respectively are diagrams of the protecting layer 24 and the lenticular lens structure 241 according to different embodiments of the present invention. As shown in FIG. 4, the thermal print head 16 can include a plurality of thermal units 161. When the print medium 20 and the protecting layer 24 pass through the thermal print head 16 along a moving direction D1, the thermal units 161 can heat the surface of the protecting layer 24 in a separated heating manner to form the lenticular lens structure 241. For example, the lenticular lens structure 241 includes a plurality of lenticular lens units 243, and each lenticular lens unit 243 includes a plurality of heating zones, such as the zones with oblique lines and the other zones without the oblique lines. All of the thermal units 161 can provide the same heat working temperature at every time interval, and each thermal unit 161 can further separately provide specific heat working temperature toward the corresponding heating zone at different time interval. Therefore, continued deformation is formed on the surface of the protecting layer 24, so that a surface of the lenticular lens structure 243 can be the flat plane, and the opposite surface of the lenticular lens structure 243 can be the semicircle structures. The thermal print head 16 can manufacture the lenticular lens units 243 of the lenticular lens structure 241 in sequence, and a structural direction D2 of the lenticular lens structure 241 can be substantially perpendicular to the moving direction D1.

As shown in FIG. 5, when the print medium 20 and the protecting layer 24 pass through the thermal print head 16 along the moving direction D1, the thermal print head 16 of the present invention can drive the thermal units 161 to heat the surface of the protecting layer 24 in the continued heating manner according to a predetermined parameter (such as the correlation between the dye regions 22, the protecting layer 24 and the print medium 20). The thermal units 161 above different heating zones can respectively provide different heat working temperature, and all of the thermal units 161 can sequentially provide its specific heat working temperature toward the protecting layer 24 when the protecting layer 24 passes through the thermal print head 16, so that a surface of the lenticular lens structure 243 can be formed as the flat plane, and the opposite surface of the lenticular lens structure 243 can formed as the semicircle structures. Thus, the structural direction D2 of the lenticular lens structure 241 can be substantially parallel to the moving direction D1. The printing device 10 of the present invention can manufacture the corresponding lenticular lens structure 241 according to user's demand (design of the interlaced mage datum).

Comparing to the prior art, the present invention can utilize the current dye sublimation printer to print the stereograph, an adhesive mechanism is unnecessary to adhere the lenticular lens structure on the print medium. The printing device of the present invention can manufacture the lenticular lens structure on the protecting layer of the conventional ribbon in the heat working manner according to the interlaced image datum when printing the stereograph, and transfer the protecting layer with the lenticular lens structure onto the print medium printed by the dye regions, so as to rapidly complete the stereograph. Therefore, the present invention has advantages of short printing period, low print cost and preferred operating convenience.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A printing device for printing a stereograph, the printing device comprising:

an actuating unit for conveying a print medium;

a ribbon, the ribbon comprising a plurality of dye regions and at least one protecting layer;

a thermal print head for respectively transferring the dye regions and the protecting layer onto the print medium, and further for manufacturing a lenticular lens structure on a surface of the protecting layer in a heat working manner; and a controller coupled to the actuating unit and the thermal print head, the controller driving the actuating unit to convey the print medium according to a target image datum, controlling the thermal print head to respectively transfer the dye regions and the protecting layer onto the print medium, and further controlling the thermal print head to manufacture the lenticular lens structure on the protecting layer when the ribbon is transferred onto the print medium.

2. The printing device of claim 1, wherein the controller sets correlation between the print medium and the lenticular lens structure of the protecting layer according to the target image datum.

3. The printing device of claim 1, wherein the controller sets correlation between the print medium and the dye regions according to the target image datum.

4. The printing device of claim 1, wherein the dye regions comprises a yellow dye region, a magenta dye region, a cyan dye region and a black dye region.

5. The printing device of claim 1, wherein the ribbon comprises a plurality of protecting layers, the thermal print head transfers the protecting layers onto the print medium in a sequential stacking manner.

6. The printing device of claim 1, wherein the thermal print head manufactures the lenticular lens structure on the surface of the protecting layer when the thermal print head transfers the protecting layer onto the print medium.

7. The printing device of claim 1, wherein the thermal print head manufactures the lenticular lens structure on the surface of the protecting layer after the thermal print head transfers the ribbon onto the print medium.

8. The printing device of claim 1, wherein the thermal print head comprises a plurality of thermal units, the thermal units heat the surface of the protecting layer in a separated heating manner, so that a structural direction of the lenticular lens structure is substantially perpendicular to a moving direction of the print medium.

9. The printing device of claim 1, wherein the thermal print head comprises a plurality of thermal units, the thermal units respectively heat the surface of the protecting layer according to a predetermined parameter in a continued heating manner, so that a structural direction of the lenticular lens structure is substantially parallel to a moving direction of the print medium.

10. The printing device of claim 1 being a dye sublimation printer.

11. A method for printing a stereograph, the method comprising:

receiving a target image datum;

moving a print medium;

transferring a plurality of dye regions and at least one protecting layer of a ribbon onto the print medium according to the target image datum when the print medium moves; and manufacturing a lenticular lens structure on a surface of the protecting layer in a heat working manner when the ribbon is transferred onto the print medium.

12. The method of claim 11, wherein receiving the target image datum comprises receiving an interlaced image datum.

13. The method of claim 11, further comprising:

setting correlation between the print medium and the lenticular lens structure of the protecting layer according to the target image datum.

14. The method of claim 11, further comprising:

setting correlation between the print medium and the dye regions according to the target image datum.

15. The method of claim 11, wherein the dye regions comprises a yellow dye region, a magenta dye region, a cyan dye region and a black dye region.

16. The method of claim 11, further comprising:

transferring a plurality of protecting layers onto the print medium in a sequential stacking manner.

17. The method of claim 11, wherein manufacturing the lenticular lens structure on the surface of the protecting layer in the heat working manner comprises:

manufacturing the lenticular lens structure on the surface of the protecting layer when the protecting layer is transferred onto the print medium.

18. The method of claim 11, wherein manufacturing the lenticular lens structure on the surface of the protecting layer in the heat working manner comprises:

manufacturing the lenticular lens structure on the surface of the protecting layer after the ribbon is transferred onto the print medium.

19. The method of claim 11, wherein manufacturing the lenticular lens structure on the surface of the protecting layer in the heat working manner comprises:

heating the surface of the protecting layer in a separated heating manner by a plurality of thermal unit, so that a structural direction of the lenticular lens structure is substantially perpendicular to a moving direction of the print medium.

20. The method of claim 11, wherein manufacturing the lenticular lens structure on the surface of the protecting layer in the heat working manner comprises:

heating the surface of the protecting layer according to a predetermined parameter in a continued heating manner by a plurality of thermal unit, so that a structural direction of the lenticular lens structure is substantially parallel to a moving direction of the print medium.

* * * * *